United States Patent [19]

Snaddon

[11] 4,191,267

[45] Mar. 4, 1980

[54] RAISE-BORING

[76] Inventor: Michael B. Snaddon, 47 Duncan Rd., Glenferness, Agricultural Holdings, Transvaal, South Africa

[21] Appl. No.: 870,809

[22] Filed: Jan. 19, 1978

[30] Foreign Application Priority Data

Jan. 19, 1977 [ZA] South Africa ..... 77/0289

[51] Int. Cl.[2] ..... E21D 3/00

[52] U.S. Cl. ..... 175/53; 173/33; 173/36; 299/55

[58] Field of Search ..... 175/94, 53, 386; 173/36, 33, 34; 299/10, 55, 31; 408/72 R

[56] References Cited

U.S. PATENT DOCUMENTS

| | | | |
|---|---|---|---|
| 2,837,324 | 6/1958 | Aschacken | 299/55 |
| 2,839,271 | 6/1958 | Kandle | 173/36 |
| 3,162,254 | 12/1964 | Rose | 173/33 |
| 3,231,029 | 1/1966 | Winberg | 175/53 |
| 3,280,416 | 10/1966 | Forsyth | 175/53 |
| 3,386,520 | 6/1968 | Lawrence et al. | 173/33 |
| 3,399,738 | 9/1968 | Haspert | 175/53 |
| 3,411,826 | 11/1968 | Wallers et al. | 299/31 |
| 3,894,402 | 7/1975 | Cherrington | 175/53 |

*Primary Examiner*—William F. Pate, III
*Attorney, Agent, or Firm*—Young & Thompson

[57] ABSTRACT

A drill hole in a rock body is collared by drilling a pilot hole into a tunnel, advancing the pilot drill across the tunnel to drill a hole in the opposite wall of the tunnel aligned with the pilot hole, mounting the borer head on an arbor located across the tunnel in both holes, rotating the borer head to collar the hole, and detaching the borer head from the arbor.

6 Claims, 1 Drawing Figure

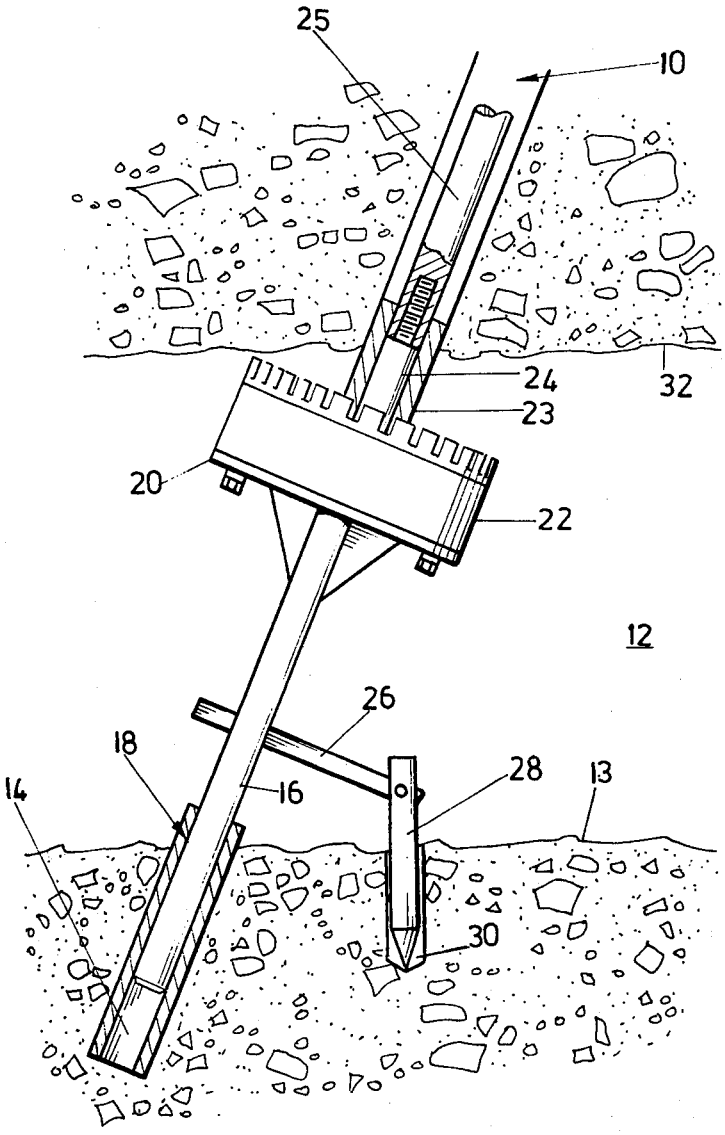
25
10
24
23
32
20
22
12
26
18
28
13
14
16
30

RAISE-BORING

This invention relates to raise-boring, for drilling from one level in a mine to another above it in which a pilot hole is drilled from one level to another, and is reamed out by a drilling head. In this specification the reaming will be considered as being from a lower to an upper level as is usually the case, but it is to be understood that the direction of reaming is immaterial.

A problem inevitably and universally present is encountered at the start of the reaming operation. The hanging wall in which the initial cut or collar is to be made by the reamer head is usually uneven and the face is not at right angles to the pilot hole. In either case, it follows that differential bending moments are applied to the reamer head stem or to the bottom drill string component (and especially to what is known as the saversub) or to related parts, from high-point contact of the cutters of the reaming head with the hanging. The repeated and excessive bending forces lead to fatigue cracks in the stem or saversub which end in failure of these components.

Another problem is that, when coupling the reamer head stem to the drill string, difficulty in aligning is encountered, as the reamer head is usually resting on an uneven surface at the lower level. An insufficiently torqued connexion can result in failure of the male thread, (or pin), on the stem, or the saversub.

The object of the present invention is to minimise these problems.

According to the invention, the pilot hole is drilled, the drill is advanced across the tunnel to drill a hole, aligned with the pilot hole, in the opposite wall, the borer head is mounted on an arbour located across the tunnel in both holes, the borer head is rotated to collar the drill hole, the borer head is detached from the arbour, and the raise is drilled.

Further according to the invention, the head stem is used as a part of the arbour in the pilot hole.

The invention is illustrated in the accompanying drawing which is a side view.

In the drawing, the pilot hole 10, drilled from the upper level (not shown) is continued across the tunnel 12 and into the footwall 13 for a distance of say, three to four meters, to form an opposed pilot hole 14.

Into the opposed hole 14 is inserted a shaft 16, preferably within a casing 18. The shaft is connected at its upper end to a turntable 20 co-axial with the shaft and forming a bolting flange with holes around it in register with a complemental series of holes in the lower face of a reaming head 22. The head stem 24 is connected to a drill string 25 ending in a saversub 23.

In operation, after the pilot hole 10 and the opposed hole 14 have been drilled, the casing 18 is inserted into the hole 14 and the shaft, with the turntable 20 attached to it, is insinuated into it. The shaft and the casing may be integral in the sense that they rotate together within the hole 14; or the casing may be an interference fit in the hole, with the shaft rotatable within it.

With the shaft extending to the base of the hole 14, the borer head 22 is positioned on the table 20 and bolted to it. The drill string 25 is then connected to the saversub 23 which is part of the head stem 24 and which is within the pilot hole. The stem with the shaft 16 constitutes an arbour to guide the borer head 22. Since the head stem is held stably and co-axially with the opposed pilot hole 14 and hence with the drill string, coupling of the head stem to the drill string is much facilitated relatively to existing procedures.

To assist in tightening of the joint, a device to lock the turntable against rotation during connection of the head stem and the drill string is required. This may be achieved by providing a cross pin 26 on the shaft and an anchor pin 28 depending from the cross pin and held in a shallow hole 30 drilled in the footwall 13, or other means, such as a spanner or a break-out tool may be used.

When the head stem has been tightened on to the drill string, the pilot hole is reamed out in the usual way. Since the head is stabilised against all movement other than axial and rotational by the arbour 16, 24, unbalanced forces imposed on the head and through it the stem or drill string during the start of reaming are contained, and the high point contact with the hanging wall 32 until a full drilling face is presented to the head becomes of no significance.

When the full drilling face has been achieved, the arbour shaft 16 is still within the casing and acting to stabilise the head, but once full face drilling starts, the function of the stabiliser has been fulfilled. The table is unbolted from the head and the stabiliser is available for the next hole.

I claim:

1. A method of collaring a drill hole from a tunnel in the art of raise-boring which includes the steps of:

drilling a pilot hole with a pilot drill in one wall of the tunnel, advancing the pilot drill across the tunnel to drill an opposed hole aligned with the pilot hole, in the opposite wall of the tunnel, mounting a borer head on an arbour, locating the arbour across the tunnel in both holes, rotating the borer head to collar the drill hole, and detaching the borer head from the arbour.

2. The method of claim 1 in which the borer head comprises a stem and the stem is used as the part of the arbour within the pilot hole.

3. The method of claim 2 in which:

the arbour is located in the opposed hole with an end exposed in the drive, a turntable is mounted on the arbour end, coaxially with the arbour, the borer head is secured to the turntable, the drill string is engaged with the borer head stem, and the drill string is raised to engage the stem in the pilot hole.

4. The method of claim 3 in which the arbour is immobilised against rotation in the opposed hole, during connection of the turntable to the borer head and of the stem to the drill string.

5. In a tunnel, apparatus for collaring a drill hole from the tunnel, in the art of raise-boring, comprising an arbour rotatably supported in one wall of the tunnel, a turntable in the tunnel connected to one end of the arbour, a borer head having a stem that extends toward the opposite wall of the tunnel, means to connect the borer head to the turntable, and means to connect a drill string that extends through said opposite wall of the tunnel to the borer head stem.

6. Apparatus as claimed in claim 5 including means to immobilise the arbour against rotation.

* * * * *